US008522805B2

(12) United States Patent
Tan

(10) Patent No.: US 8,522,805 B2
(45) Date of Patent: Sep. 3, 2013

(54) STRUCTURE OF SELF-OPENING/CLOSING UMBRELLA

(75) Inventor: Hong-Wei Tan, Chongqing (CN)

(73) Assignee: Yung-Hsiang Liu, Chiayi (TW)

( * ) Notice: Subject to any disclaimer, the term of this patent is extended or adjusted under 35 U.S.C. 154(b) by 123 days.

(21) Appl. No.: 13/241,254

(22) Filed: Sep. 23, 2011

(65) Prior Publication Data

US 2013/0074892 A1 Mar. 28, 2013

(51) Int. Cl.

| | |
|---|---|
| ***A45B 25/16*** | (2006.01) |
| ***A45B 25/14*** | (2006.01) |
| ***A45B 19/04*** | (2006.01) |
| ***A45B 19/08*** | (2006.01) |

(52) U.S. Cl.
USPC ..... 135/24; 135/25.4

(58) Field of Classification Search
USPC ..... 135/15.1, 22, 24, 25.4
See application file for complete search history.

(56) References Cited

U.S. PATENT DOCUMENTS

| | | | | |
|---|---|---|---|---|
| 3,171,418 | A * | 3/1965 | Meyer | 135/26 |
| 5,803,102 | A * | 9/1998 | Ko | 135/24 |
| 6,112,755 | A * | 9/2000 | Lin et al. | 135/24 |
| 8,365,747 | B1 * | 2/2013 | Su | 135/24 |
| 2003/0062074 | A1 * | 4/2003 | Kuo | 135/24 |
| 2011/0214704 | A1 * | 9/2011 | Chang | 135/23 |
| 2011/0284043 | A1 * | 11/2011 | Kuo | 135/24 |
| 2012/0305038 | A1 * | 12/2012 | Ko | 135/22 |

* cited by examiner

*Primary Examiner* — David Dunn
*Assistant Examiner* — Danielle Jackson
(74) *Attorney, Agent, or Firm* — Leong C. Lei

(57) ABSTRACT

A self-opening/closing umbrella includes a central shaft unit having an improved structure. The central shaft unit forms a raised channel on one side of a third shaft segment and a pulley is pivotally mounted to a lower portion of the raised channel. A second shaft segment has a top to which an internal plug including a pulley is fixed and includes a first pull rope having an end fixed to a bullet-head member and an opposite end extending upward to warp around the pulley of the internal plug, projecting through a sideway slot, extending downward to wrap around the pulley inside the third shaft segment for upward extension to fix to a top end of the third shaft segment. A second pull rope has an end fixed to the internal plug and an opposite end extending across a top cap to project outward to fix to the runner.

2 Claims, 7 Drawing Sheets

STRUCTURE OF SELF-OPENING/CLOSING UMBRELLA

TECHNICAL FIELD OF THE INVENTION

The present invention generally relates to a structural improvement of self-opening/closing umbrella, which comprises an improvement of the configuration of a central shaft unit of a self-opening/closing umbrella so that the improved self-opening/closing umbrella allows easy accomplishment of the final compression for closing the umbrella thereby significantly reducing the risk caused by the compression and closing operation of umbrella.

DESCRIPTION OF THE PRIOR ART

The structure and operation of a commonly seen self-opening/closing umbrella are generally illustrated in FIGS. 1-3, wherein a three-folded umbrella is taken as an example for explanation, which generally comprises a handle (20) inside which an operation unit (10) is provided, a central shaft unit (30) inside which an umbrella opening spring (60) is received, and a runner (40) coupled to ribs (70) and comprising a pulley around which a pull rope (51) having an end fixed to a top cap (41) and an opposite end wrapping around a pulley mounted inside the top cap (41) and fixed to a bullet-head member (50) warps. The operation unit (10) comprises a body having a hollow interior inside which components including a control ring (11), a control bar (12), and a pushbutton (13) are received. The control bar (12) is pivoted to a lower portion of one side of the control ring (11). The pushbutton (13) is received in an opening formed in a side wall of the handle (20) and is exposed for controlling the extension and contraction of the central shaft unit (30).

As shown in FIG. 1, the control ring (11) comprises a small spring (111) externally set at one side thereof. The control ring (11) forms therein a projection bar (112) at a location corresponding to the small spring (111) to engage and retain the runner (40) for keeping the umbrella in a collapsed condition. Further, the control bar (12) is coupled by a pivot pin (121) to the bottom of the control ring (11) at a location close to the pushbutton and comprises a torsion spring (122) that normally maintains the control bar (12) in a horizontal condition. When the umbrella is in a compressed and ready-to-use condition, the runner (40) is retained in position by the projection bar (112) of the control ring (11) and the control bar (12) is pushed downward by a second shaft segment (32) of the central shaft unit (30) to become inclined. The bullet-head member (50) is pushed by an inner tube (34) received in a third shaft segment (33) and biased by a spring plate (311) to engage a retention hole defined in a first shaft segment (31) of the central shaft unit (30). As shown in FIG. 2, when the pushbutton (13) is depressed for the first time, the control ring (11) is pushed inward to have the projection bar (112) disengaging from the runner (40) and under the action of the umbrella opening spring (60) received inside the central shaft unit (30), opening operation of the umbrella is automatically carried out and under this condition, the control bar (12) returns to the normal horizontal condition and contacts the bullet-head member (50).

As shown in FIG. 3, to close the umbrella, the pushbutton (13) is pressed down again, and the control bar (12) pushes and causes the bullet-head member (50) to disengage from the first shaft segment (31), allowing the runner (40) to become movable. Under the action of the umbrella closing springs (71) provided on the ribs (70), the ribs (70) and an umbrella canopy (not shown) are automatically collapsed and the runner (40) is moved downward. Afterward, the top end of the umbrella can be forcibly pushed to compress the central shaft unit (30) toward the handle (20), thereby completing the closing of the umbrella as shown in FIG. 1.

However, several problems can be found in the operation of the above mentioned self-opening/closing umbrella:

(1) Pressing down the pushbutton to close the umbrella only collapse the ribs and a canopy of the umbrella, and the central shaft unit is still kept in a condition where the three segments are fully extended to set the umbrella in the greatest length thereof. It is difficult for a woman or a child whose hands are relatively short to hand grip and compress the central shaft unit toward the handle for completely closing the umbrella.

(2) The umbrella opening spring that normally shows a length spanning from the first shaft segment to the top end of the third shaft segment is of quite a strength and spring force, so that a user must apply a great force with his or her hands to compress and close the umbrella. This makes it difficult for a woman or a child whose hands are of relatively weak physical strength to compress and close the umbrella.

(3) Since the strength and spring force of the umbrella opening spring are great, if, in an attempt to close the umbrella, the application of force or the operation of closing the umbrella is in error, the compressed umbrella opening spring will spring the central shaft unit back with a great force. This often hurts the hands or other portions of the body of the user.

Thus, the known self-opening/closing umbrella is of a design that is imperfect and may cause inconvenience and danger in the use thereof.

SUMMARY OF THE INVENTION

A primary objective of the present invention is to provide a self-opening/closing umbrella that allows a runner and a third shaft segment to simultaneously move downward so as to shorten the central shaft unit in closing an umbrella, whereby an operation of compressing and closing the umbrella is made easy and potential risk is significantly reduced.

Another objective of the present invention is to shorten the overall length of an umbrella opening spring so as to reduce the strength and spring force thereof, but still allowing full expansion of a central shaft unit, whereby hurting caused in compressing and closing the umbrella can be avoided.

A further objective of the present invention is provide an inner tube inside a second shaft segment of a central shaft unit in order to prevent an umbrella opening spring from reducing the spring force thereof due to twisting and deformation caused by squeezing in compressing and closing the umbrella and also to prevent the twisted and deformed umbrella opening spring from interfering with downward movement of the inner tube, making the operation of compressing and closing the umbrella easy and effortless.

To achieve the above objectives, the present invention provides a self-opening/closing umbrella that comprises an improvement of the configuration of a central shaft unit, wherein a raised channel is formed on one side of the third shaft segment. The raised channel has a lower portion to which a pulley is pivotally mounted. The second shaft segment has a top end to which an internal plug that forms centrally a through hole is coupled. The internal plug forms a sideway slot in a side wall thereof. A pulley is pivotally mounted inside the sideway slot. The inner tube of the central shaft unit has a top end fixed inside the through hole of the internal plug. The inner tube forms in a side wall thereof a vertically-extending open slit. A first pull rope is provided, having an end fixed to a top end of a bullet-head member and an opposite end extending upward to wrap around the pulley of the internal plug and projecting out of the sideway slot to wrap around lower side of the pulley inside the third shaft segment for upward extension to fix to a top end of the third shaft segment or a bottom of a top cap. A second pull rope is further provided, having an end fixed to a top end of the internal plug and an opposite end extending upward to warp around a pulley inside the top cap and project outward for fixing to a top of the runner. Further, an umbrella opening spring that is arranged inside the central shaft unit has a lower end positioned inside the first shaft segment and an upper end supported on the bottom of the internal plug of the second shaft segment.

With such an arrangement, to open the umbrella, a pushbutton is pressed down to allow the umbrella opening spring to push the second shaft segment upward. With the first pull rope and the second pull rope respectively driving the third shaft segment and the runner upward, the operation of opening the umbrella is completed. To close the umbrella, the pushbutton is pressed down again, whereby the tension of the first pull rope is released to turn into a slack condition. Umbrella closing springs then drive the runner and the third shaft segment downward to have the third shaft segment completely fit over the second shaft segment and thus shortening the overall length of the central shaft unit to make the final compression and closing operation of the umbrella to be carried out in a convenient an easy manner.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
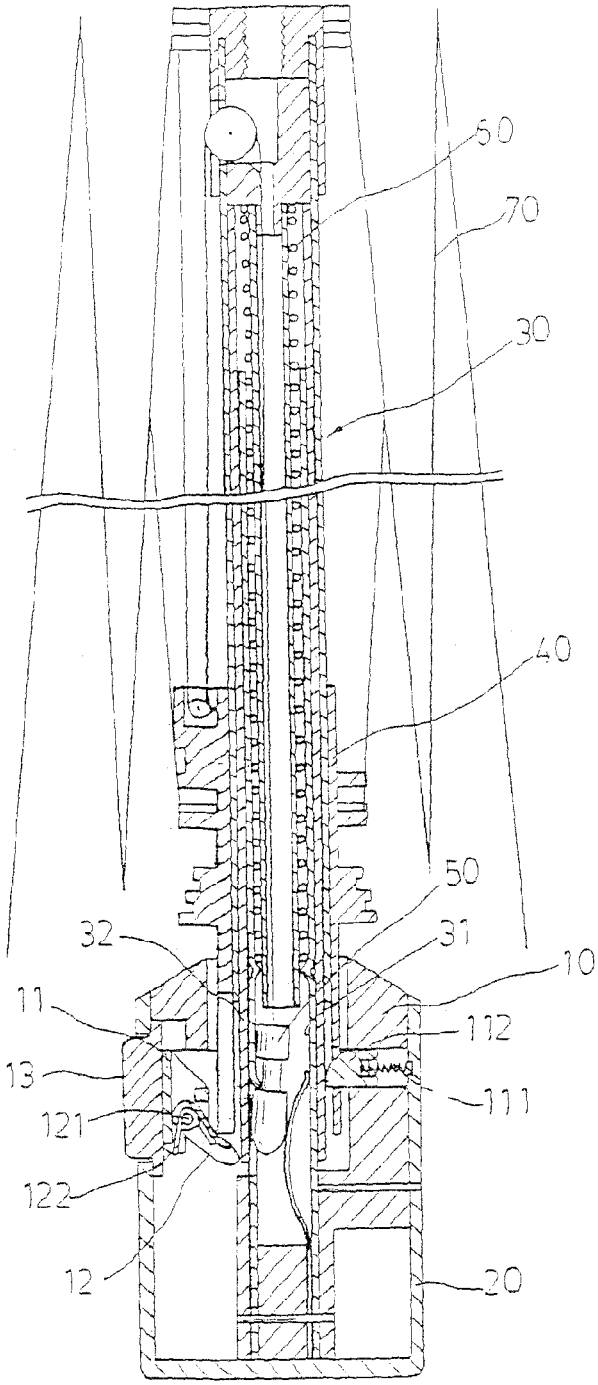
FIG.1 PRIOR ART
FIGS. 1-3 are cross-sectional views illustrating the structure and operation of a conventional self-opening/closing umbrella.
Figure 2:
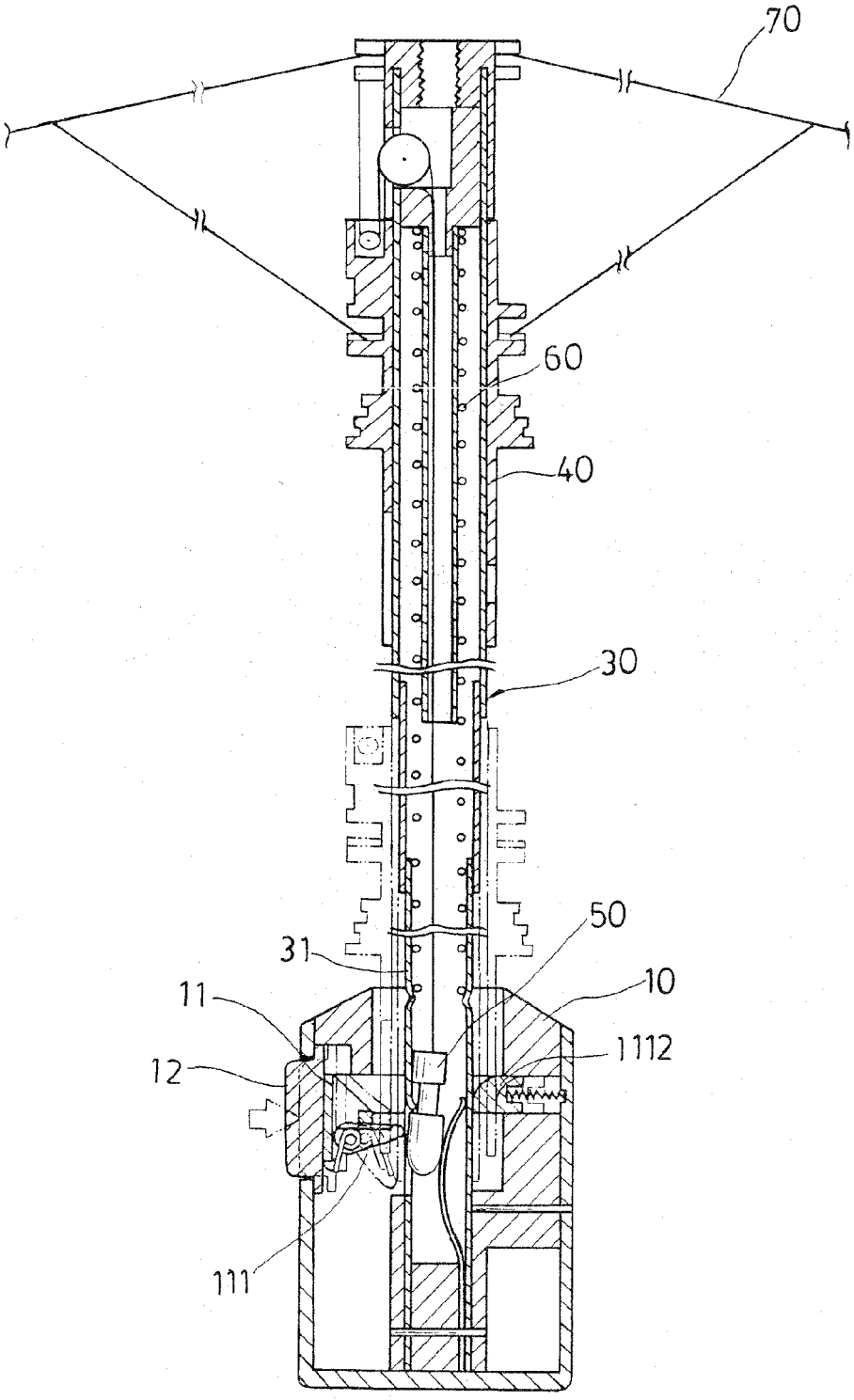
FIG.2 PRIOR ART
Figure 3:
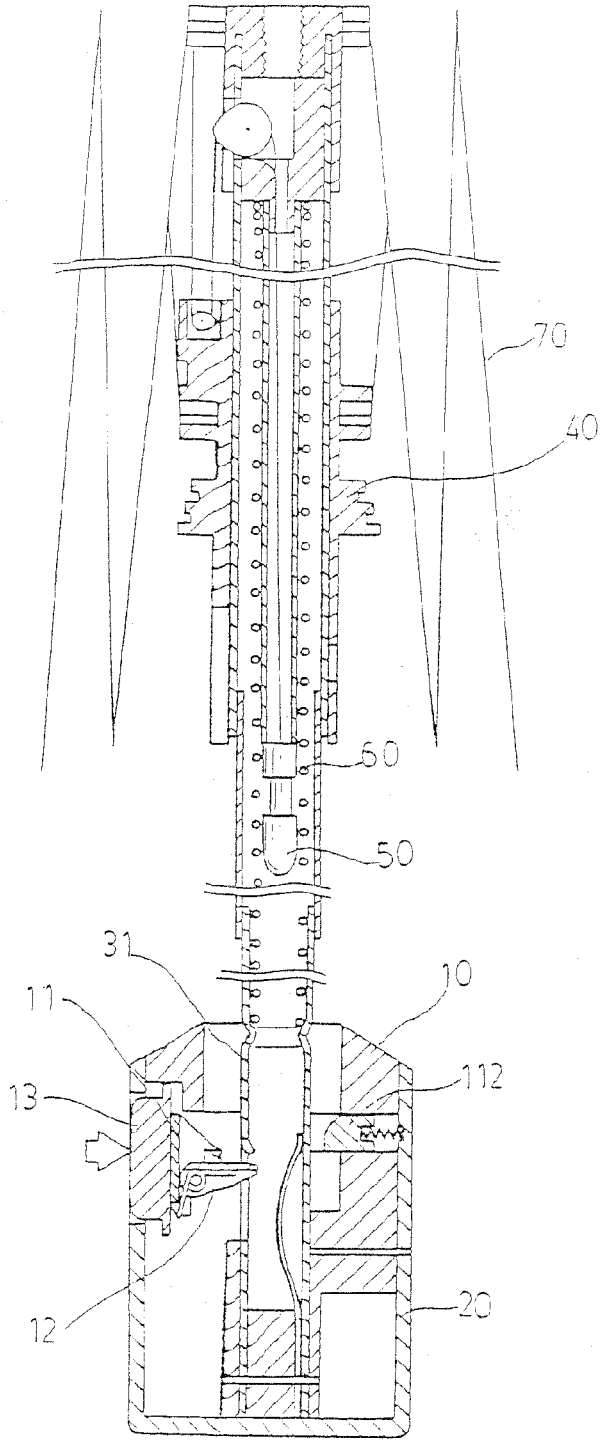
FIG.3 PRIOR ART
Figure 4:
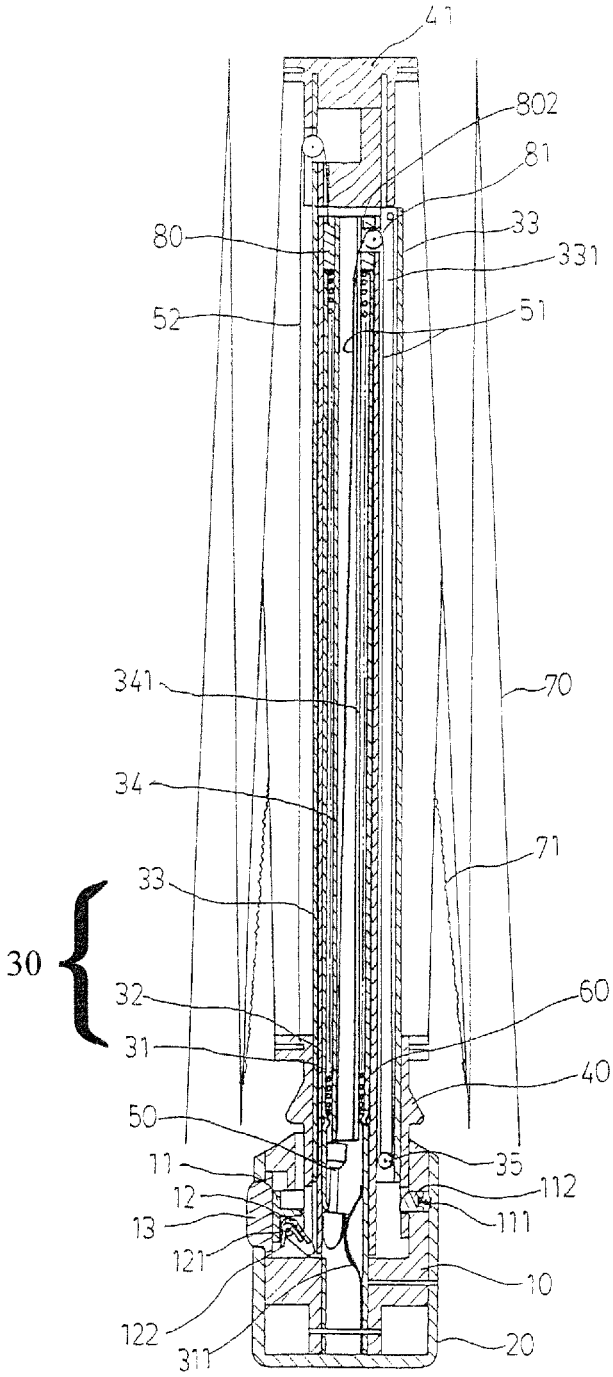
FIG. 4 is a cross-sectional view illustrating a self-opening/closing umbrella according to the present invention in a compressed condition before the umbrella is opened.

Referring to FIG. 4, the present invention provides a self-opening/closing umbrella that will be explained by taking a three-folded umbrella as an example. The umbrella generally comprises an operation unit (10), a handle (20), a central shaft unit (30), a runner (40), a top cap (41), a bullet-head member (50), an umbrella opening spring (60), and a plurality of ribs (70) and umbrella closing springs (71). The operation unit (10) is arranged inside the handle (20) and comprises a body having a hollow interior inside which a control ring (11) and a pushbutton (13) that is received in an opening formed in a side wall of the handle (20) and is exposed are received. A control bar (12) is mounted to a lower portion of one side of the control ring (11). The control ring (11) comprises a small spring (111) externally set at one side thereof. The control ring (11) forms therein a projection bar (112) at a location corresponding to the small spring (111) to engage and retain the runner (40) for keeping the umbrella in a collapsed condition. Further, the control bar (12) is coupled by a pivot pin (121) to the bottom of the control ring (11) at a location close to the pushbutton and comprises a torsion spring (122) that normally maintains the control bar (12) in a horizontal condition. The central shaft unit (30) is composed of a first shaft segment (31), a second shaft segment (32), and a third shaft segment (33) that are telescopically received in each other. The central shaft unit (30) receives therein an inner tube (34) that has a top end fixed inside the second shaft segment (32). The first shaft segment (31) of the central shaft unit (30) has a bottom end fixed to the body of the operation unit (10). The umbrella opening spring (60) is arranged inside the central shaft unit (30). Each of the ribs (70) is coupled between the runner (40) and the top cap (41).

Figure 7:
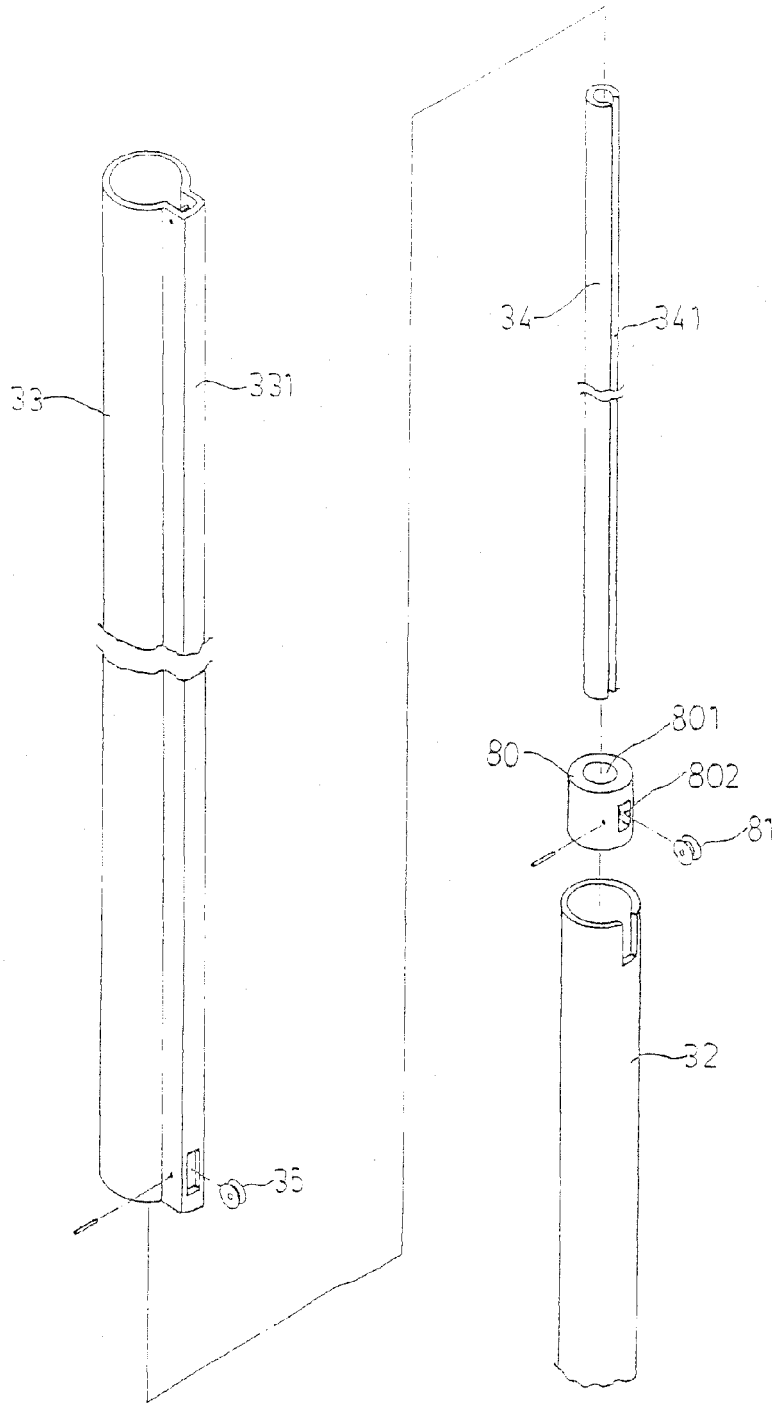
FIG. 7 is an exploded view of a central shaft unit of the self-opening/closing umbrella according to the present invention.

Referring to FIGS. 4 and 7, an improved feature of the present invention is associated with the configuration of the central shaft unit (30) of the umbrella, which comprises a raised channel (331) formed on and extending along one side of the third shaft segment (33). The raised channel (331) has a lower portion to which a pulley (35) is pivotally mounted. The second shaft segment (32) has a top end to which an internal plug (80) is coupled. The internal plug (80) forms, in a center thereof, a central through hole (801), and also forms, in a side wall thereof, a sideway slot (802). A pulley (81) is pivotally mounted inside the sideway slot (802). The inner tube (34) of the central shaft unit (30) has a top end fixed inside the central through hole (801) of the internal plug (80) and has a length substantially corresponding to the second shaft segment (32). The inner tube (34) forms in a side wall thereof a vertically-extending open slit (341). Further, a first pull rope (51) and a second pull rope (52) are provided. The first pull rope (51) has an end fixed to a top end of the bullet-head member (50) at a bottom end of the inner tube (34) and an opposite end extending upward within the inner tube (34) and further extending outward through the open slit (341) to wrap around the pulley (81) of the internal plug (80) to project out of the sideway slot (802) and enter the raised channel (331) of the third shaft segment (33) for further and downward extension to reach and wrap around the lower side of the pulley (35) for upward extension to fix to a top end of the third shaft segment (33) or a bottom of the top cap (41). The second pull rope (52) has an end fixed to a top end of the internal plug (80) and an opposite end extending upward to wrap around a pulley mounted inside the top cap (41) to project outward for fixing to a top of the runner (40). Further, the umbrella opening spring (60) arranged inside the central shaft unit (30) is significantly reduced of the overall length thereof but with a lower end thereof remaining positioned inside the first shaft segment (31) and an upper end supported on the bottom of the internal plug (80) of the second shaft segment (32), whereby an upper portion of the umbrella opening spring (60) encompassing outside the inner tube (34).

Referring to FIG. 4, which illustrates the self-opening/closing umbrella in a ready-to-use condition after being compressed, the umbrella opening spring (60) arranged in the central shaft unit (30) is in a compressed condition and the runner (40) is retained in position by the projection bar (112) of the control ring (11) and the control bar (12) is pushed downward by the second shaft segment (32) of the central shaft unit (30) to become inclined. The bullet-head member (50) is pushed by the inner tube (34) and biased by a spring plate (311) to engage a retention hole defined in the first shaft segment (31).

Figure 5:
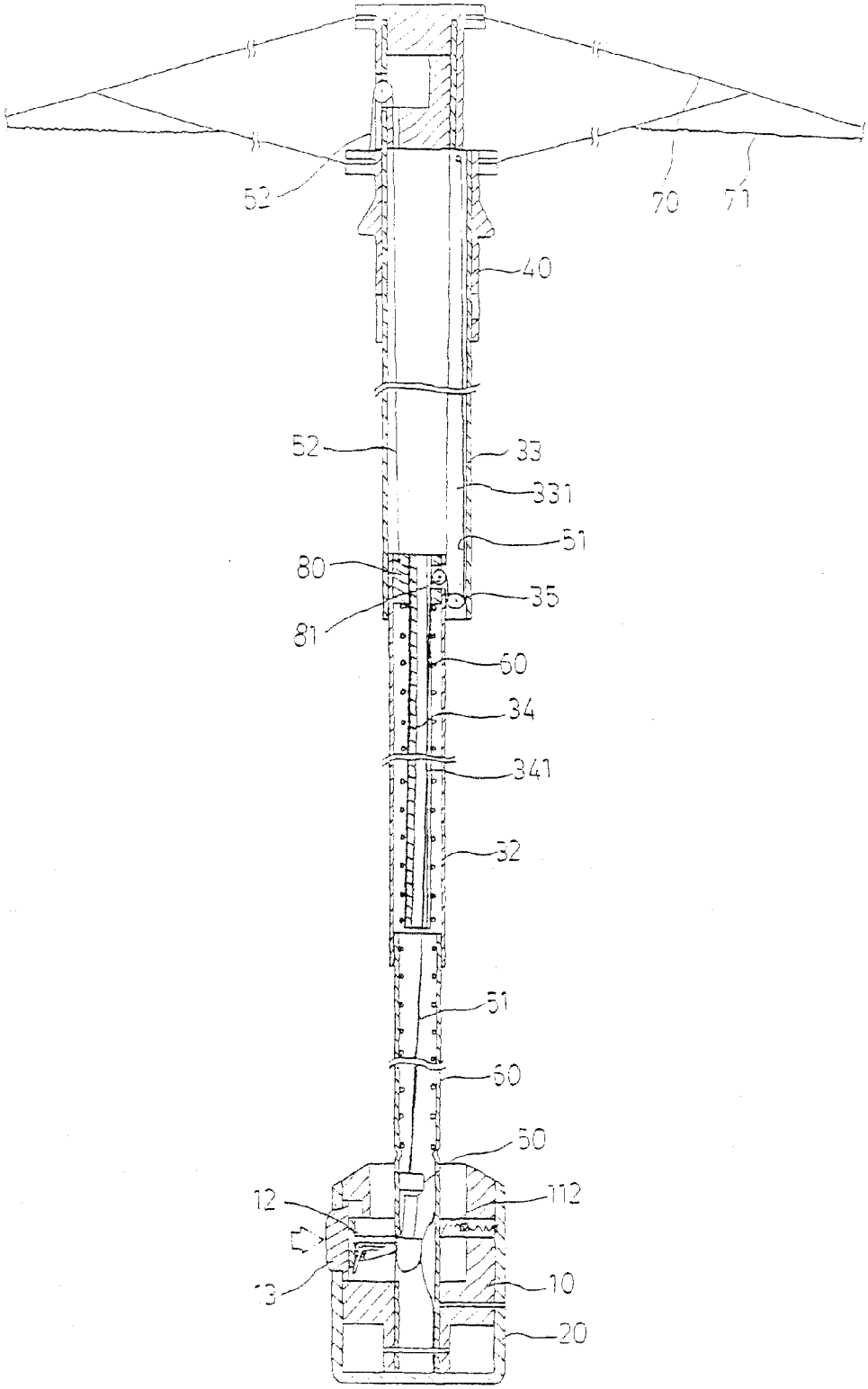
FIG. 5 is a cross-sectional view illustrating the umbrella of the present invention in an open condition.

Referring to FIG. 5, to close the umbrella, the pushbutton (13) is pressed down. The control ring (11) is pushed inward to have the projection bar (112) disengaging from the runner (40), and under the action of the spring force of the umbrella opening spring (60) received inside the central shaft unit (30), the second shaft segment (32) is pushed upward, but at this moment, the bullet-head member (50) is still kept in engagement with the retention hole of first shaft segment (31), whereby with the cooperation among the first pull rope (51), the pulley (81), and the pulley (35), the third shaft segment (33) is pulled to have the third shaft segment (33) moving upward. At this moment, the runner (40) is pulled by the second pull rope (52) to move upwards thereby fully expanding the ribs (70) and automatically completing umbrella opening operation. At this moment, the umbrella closing springs (71) that are respectively arranged on the ribs (70) assume an expansion condition. Further, the control bar (12) returns to the normal horizontal condition and contacts the bullet-head member (50).

Figure 6:
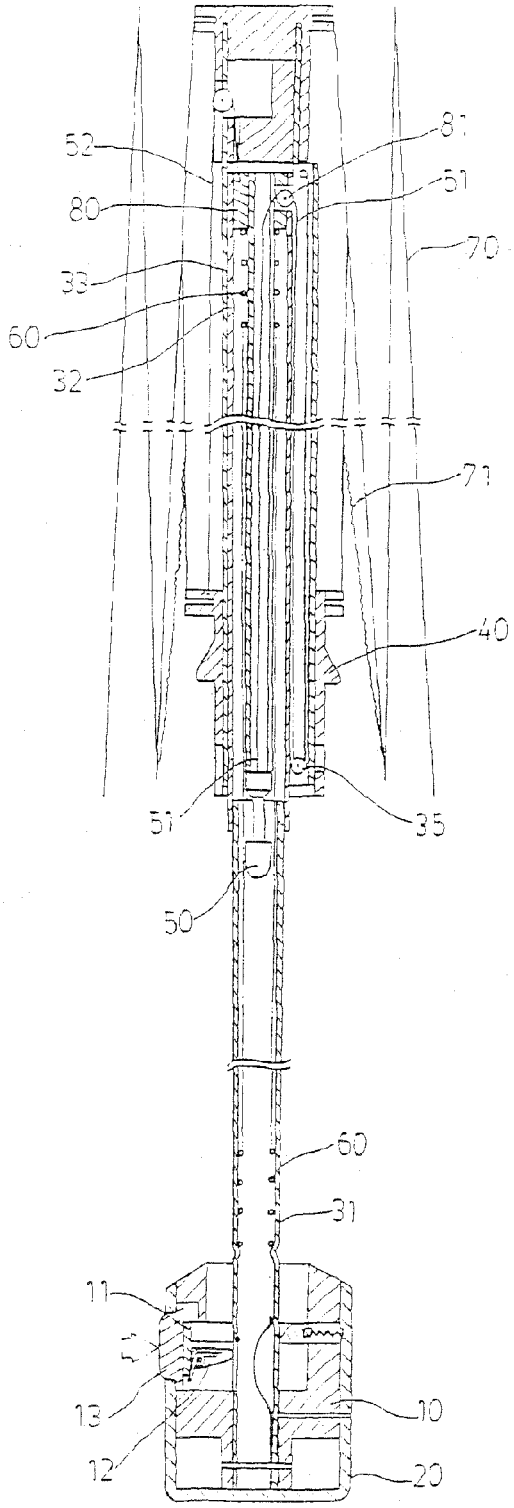
FIG. 6 is a cross-sectional view illustrating a closing operation of the umbrella according to the present invention.

Referring to FIG. 6, to close the umbrella, the pushbutton (13) is pressed down again, and the control bar (12) pushes and causes the bullet-head member (50) to disengage from the first shaft segment (31). At this moment, the retention force of the first pull rope (51) and the third shaft segment (33) is released. Under the action of the umbrella closing springs (71) provided on the ribs (70), the ribs (70) and the umbrella canopy are automatically collapsed and the runner (40) is moved downward. The third shaft segment (33) is caused to telescopically move downward to fit over the second shaft segment (32), making the expanded the central shaft unit (30) converted into a length of only two shaft segments. As such, the subsequent compression operation is made easy and convenient.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of self-opening/closing umbrella, which comprises an operation unit, a handle, a central shaft unit, a runner, a top cap, a bullet-head member, an umbrella opening spring, and a plurality of ribs and umbrella closing springs, the operation unit being arranged inside the handle and comprising a body inside which a control ring is installed and a pushbutton that is received in an opening formed in a side wall of the handle, a control bar being mounted to a lower portion of one side of the control ring, the control ring comprising a small spring externally set at one side thereof, the control ring forming therein a projection bar at a location corresponding to the small spring to engage and retain the runner for keeping the umbrella in a collapsed condition, the central shaft unit comprising a first shaft segment, a second shaft segment, and a third shaft segment that are telescopically received in each other, the central shaft unit receives therein an inner tube, the first shaft segment of the central shaft unit having a bottom end fixed to the body of the operation unit, the top cap being fixed to a top of the third shaft segment, the umbrella opening spring being arranged inside the central shaft unit, each of the ribs being coupled between the runner and the top cap, the improvements comprising a raised channel formed on one side of the third shaft segment, the raised channel having a lower portion to which a first pulley is pivotally mounted, the second shaft segment having a top end to which is coupled an internal plug that forms centrally a through hole, the internal plug forming a sideway slot in a side wall thereof, a second pulley being pivotally mounted inside the sideway slot, a first pull rope having an end fixed to a top end of the bullet-head member and an opposite end extending upward to wrap around the second pulley of the internal plug and projecting out of the sideway slot to wrap around lower side of the first pulley inside the third shaft segment for upward extension to fix to a top end of the third shaft segment or a bottom of the top cap, a second pull rope having an end fixed to a top end of the internal plug and an opposite end extending upward to run across the top cap and project outward for fixing to a top of the runner, the umbrella opening spring that is arranged inside the central shaft unit having a lower end positioned inside the first shaft segment and an upper end supported on the bottom of the internal plug of the second shaft segment.

2. The structure of self-opening/closing umbrella according to claim 1, wherein the inner tube has a top end fixed inside the through hole of the internal plug of the second shaft segment and has a length substantially corresponding to the second shaft segment and forms in a side wall thereof a vertically-extending open slit.

* * * * *